US005628434A

United States Patent [19]

Foster et al.

[11] Patent Number: 5,628,434

[45] Date of Patent: May 13, 1997

[54] TRIGGER SPRAYER HAVING A PRESSURE BUILDUP VALVE

[75] Inventors: Donald D. Foster, St. Charles; Philip L. Nelson, Ellisville, both of Mo.

[73] Assignee: Contico International, Inc., St. Lous, Mo.

[21] Appl. No.: 459,308

[22] Filed: Jun. 2, 1995

Related U.S. Application Data

[63] Continuation-in-part of Ser. No. 363,512, Dec. 12, 1994.

[51] Int. Cl.[6] ..... B67D 5/42

[52] U.S. Cl. ..... 222/383.1; 239/333

[58] Field of Search ..... 239/333, 337, 239/571; 222/383.1

[56] References Cited

U.S. PATENT DOCUMENTS

| | | | |
|---|---|---|---|
| 3,995,774 | 12/1976 | Cooprider et al. | 222/207 |
| 4,082,223 | 4/1978 | Nozawa | 239/333 |
| 4,155,487 | 5/1979 | Blake | 222/207 |
| 4,174,056 | 11/1979 | Loeffler | 239/333 X |
| 4,183,449 | 1/1980 | Blake | 222/340 X |
| 4,201,317 | 5/1980 | Aleff | 222/207 |
| 4,204,614 | 5/1980 | Reeve | 222/153 |
| 4,225,061 | 9/1980 | Blake et al. | 222/207 |
| 4,228,931 | 10/1980 | Ruscitti et al. | 239/333 X |
| 4,260,079 | 4/1981 | Cary et al. | 222/209 |
| 4,277,001 | 7/1981 | Nozawa | 239/333 X |
| 4,365,751 | 12/1982 | Saito et al. | 222/383.1 X |
| 4,489,861 | 12/1984 | Saito et al. | 222/383.1 X |
| 4,923,094 | 5/1990 | O'Neill | 222/378 |
| 5,114,052 | 5/1992 | Tiramani et al. | 239/333 X |
| 5,190,191 | 3/1993 | Reyman | 222/256 |
| 5,244,126 | 9/1993 | Geier | 239/333 X |
| 5,297,701 | 3/1994 | Steijns et al. | 222/153 |
| 5,299,717 | 4/1994 | Geier | 239/333 X |
| 5,318,206 | 6/1994 | Maas et al. | 222/383.1 X |
| 5,332,128 | 7/1994 | Mass et al. | 239/333 X |
| 5,341,965 | 8/1994 | Maas et al. | 239/333 X |
| 5,341,967 | 8/1994 | Silvenis | 222/383.1 X |
| 5,351,863 | 10/1994 | Cecil et al. | 222/259 |
| 5,385,302 | 1/1995 | Foster et al. | 239/333 |

FOREIGN PATENT DOCUMENTS

96/12671 5/1996 WIPO .

*Primary Examiner*—Lesley D. Morris

*Attorney, Agent, or Firm*—Howell & Haferkamp, L.C.

[57] ABSTRACT

A trigger sprayer contains a pressure buildup valve that prevents liquid from being dispensed from the sprayer until the pressure of the liquid pumped from the sprayer pump exceeds a predetermined minimum pressure.

22 Claims, 6 Drawing Sheets

TRIGGER SPRAYER HAVING A PRESSURE BUILDUP VALVE

This application is a continuation-in-part of Application Ser. No. 08/363,512, filed Dec. 12, 1994, and currently pending.

BACKGROUND OF THE INVENTION (1) Field Of The Invention

The present invention pertains to a trigger sprayer containing a valve element that, while the pump is being primed, vents air from a pump chamber of the sprayer to the interior of a liquid container to which the sprayer is attached.

(2) Description Of The Related Art

A pressure buildup sprayer is a general category of sprayer in which liquid dispensed from the sprayer is first raised to a certain pressure level before it is dispensed from the sprayer. Typically, sprayers of this type contain a manually operable pump that draws liquid from a container to which the sprayer is attached, and dispenses the liquid from a nozzle orifice of the sprayer. Positioned within the sprayer between the pump and the nozzle orifice is a pressure regulator or pressure buildup valve that regulates the pressure of the liquid dispensed from the nozzle orifice. In operation, as liquid is drawn from the container to the pump and is then made to flow from the pump toward the nozzle orifice in response to actuation of the pump, a pressure regulator positioned in the liquid flow path between the pump and nozzle orifice prevents the flow of liquid to the orifice until the liquid is raised to a certain pressure level at which the regulator opens communication to the nozzle orifice and the liquid is dispensed from the sprayer.

In prior art pressure buildup sprayers, difficulties are frequently encountered in first priming the pump of the sprayer with liquid from the container to which it is attached. In priming the sprayer pump, air in the pump chamber must be displaced as liquid from the container is drawn into the pump chamber. However, due to the compressibility of the air in the pump chamber, it is often difficult to raise the pressure of the air by actuation of the sprayer pump to the level required to open the pressure regulator and permit the air to be displaced from the pump chamber and through the pressure regulator and the nozzle orifice. Frequently, the biasing force of the pressure regulator valve in prior art pressure buildup sprayers is too large to be overcome by the increased pressure of the air in the pump chamber when priming the pump due to the compressibility of the air.

SUMMARY OF THE INVENTION

It is an object of the invention to provide a pressure buildup sprayer in which the air contained in the pump chamber is vented to the interior of a liquid container to which the sprayer is attached when priming the pump, while minimizing the number of component parts of the sprayer.

The pressure buildup sprayer of the present invention is a trigger sprayer; however, the novel features of the sprayer may be employed in other types of pressure buildup sprayers in overcoming the problem of venting air from the sprayers' pump chambers when priming the pump chambers. The trigger sprayer of the invention is generally comprised of a sprayer housing containing a liquid discharge passage, a pump chamber, a vent chamber, and a liquid passage communicating the discharge passage, pump chamber and vent chamber with each other and with the interior of a liquid container to which the sprayer housing is attached. A pump piston is mounted in the pump chamber and is operatively connected to a trigger on the sprayer housing for reciprocating movement of the pump piston in the pump chamber in response to pivoting movement of the trigger on the sprayer housing. Positioned in the liquid passage between the pump chamber and the liquid container is a check valve. A pressure regulator valve or pressure buildup valve is also positioned in the liquid passage between the pump chamber and the discharge passage. The pressure buildup valve is spring biased to a closed position blocking communication of liquid from the pump chamber to the discharge passage. The pressure buildup valve is forced from its closed position to an open position communicating the pump chamber with the liquid discharge passage when the pump is actuated, causing liquid in the pump chamber to build up to a pressure level that forces the pressure buildup valve to move to its opened position.

A valve element in the form of a resilient, tubular sleeve is positioned in the liquid passage adjacent the vent chamber. An exit port extends through the sprayer housing between the vent chamber and the liquid passage. The valve element in its at rest position closes over the exit port. The tubular configuration of the valve element permits fluid communication between the interior of the liquid container and the pump chamber through the valve element interior.

A vent piston is mounted in the vent chamber and is connected to the pump piston of the trigger sprayer. The vent piston has a projecting rod connected thereto. On reciprocation of the vent piston in the vent chamber in response to manual pivoting of the trigger, the vent piston rod is extended through the exit port and engages against a side of the valve element, displacing the valve element from its closed position over the exit port. The displacement of the valve element communicates the interior of the pump chamber with the interior of the vent chamber through a section of the liquid passage and the exit port. The vent chamber in turn communicates with the interior of the liquid container through a slot opening in the vent chamber. When priming the pump of the trigger sprayer, the air in the pump chamber is forced through a section of the liquid passage bypassing the valve element, through the exit port, the vent chamber, and the slot opening in the vent chamber into the interior of the liquid container. In this manner, the air in the pump chamber of the trigger sprayer is vented from the pump chamber without the necessity of the compressed air unseating the pressure buildup valve and without liquid of the container leaking from the trigger sprayer.

In an alternate embodiment of the present invention, the above described check valve in the liquid passage and the valve element are replaced by a valve element having an integral check valve, thereby reducing the number of component parts of the sprayer and simplifying its assembly.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENTS

Figure 1:
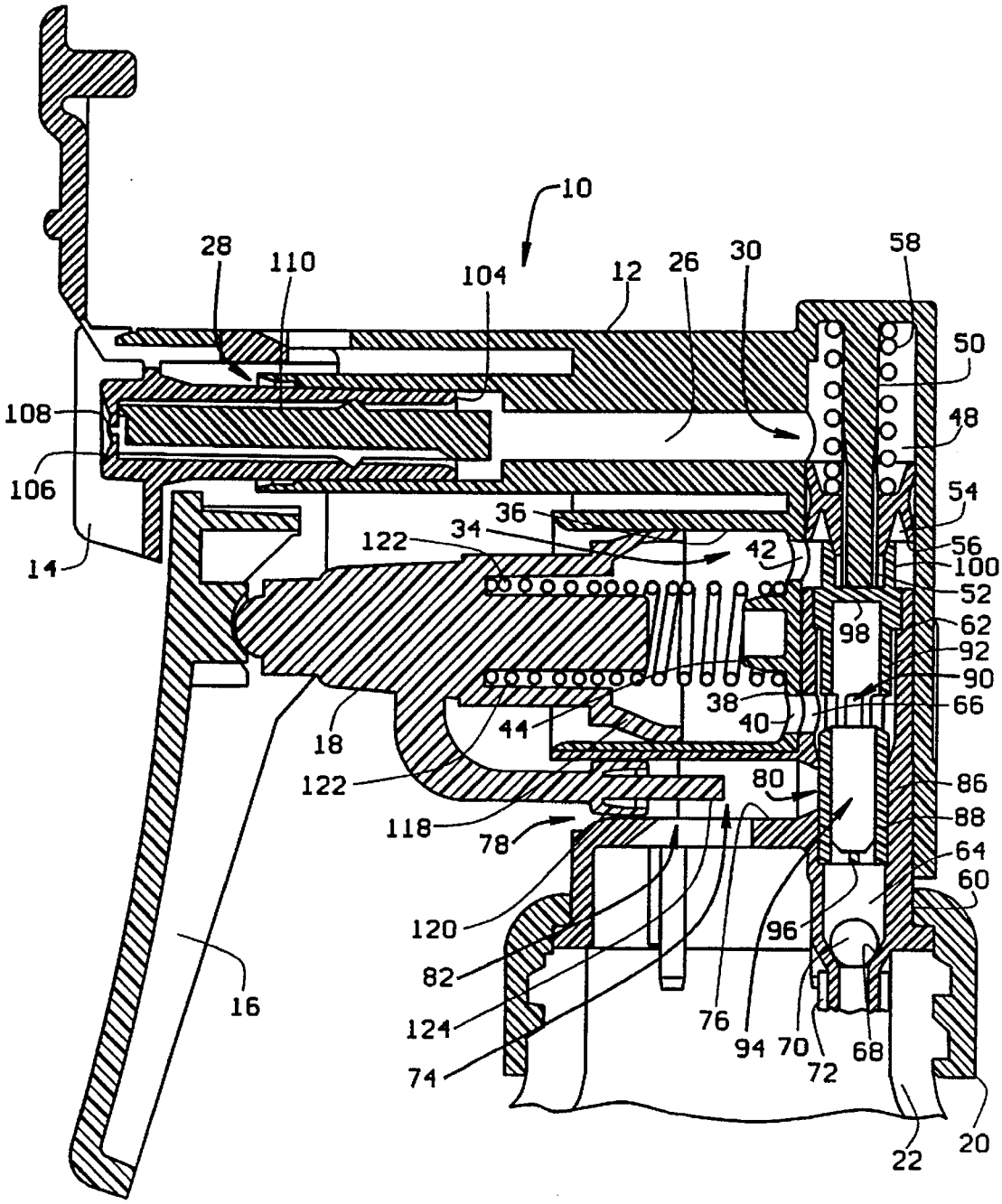
FIG. 1 is a side elevation view, in section, of the pressure buildup trigger sprayer of the invention.
Figure 2:
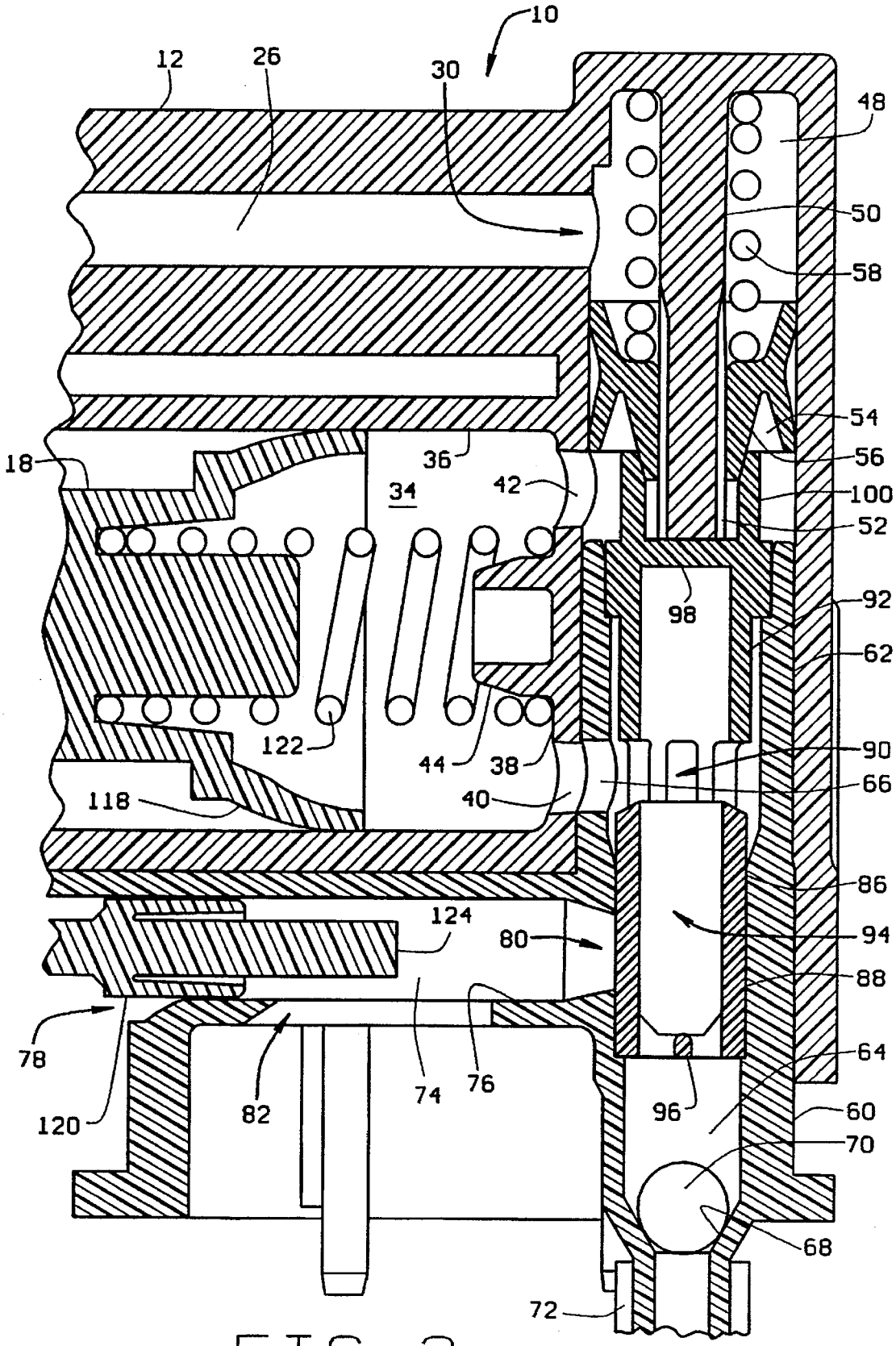
FIG. 2 is a partial elevation view of the trigger sprayer, in section, showing relative positions of the component parts of the trigger sprayer prior to actuation of the pump in priming the pump.

FIG. 1 shows the pressure buildup trigger sprayer 10 of the present invention. The trigger sprayer is basically comprised of a sprayer housing 12, a nozzle head 14, a trigger 16, and a piston assembly 18. In the preferred embodiment, each of these component parts is constructed of plastic material; however, other types of materials may be employed in their construction without departing from the intended scope of the invention. The sprayer housing also comprises a vent chamber section. A cap 20 connects the vent chamber section of the housing to a liquid container 22. In variant embodiments of the trigger sprayer, the cap may be mounted to the sprayer housing for relative rotation thereto as is shown, or it may be integrally formed with the sprayer housing and connect to the container by a bayonet type connector. Furthermore, although the novel construction of the pressure buildup sprayer is shown and described with reference to a trigger sprayer, it should be understood that the construction of the sprayer may be employed in other types of sprayers, for example pump sprayers, without departing from the intended scope of the invention.

The trigger sprayer housing 12 contains a liquid discharge passage 26 having a center axis and a nozzle head opening 28 at the left hand end and an inlet opening 30 at the axially opposite right hand end of the liquid discharge passage as seen in FIG. 1.

Directly below the liquid discharge passage 26 in the sprayer housing 12 is a pump chamber 34. The interior of the pump chamber 34 is surrounded by a cylindrical side wall 36 and a circular back wall 38. An inlet port opening 40 and an outlet port opening 42 pass through the back wall 38 of the pump chamber. Positioned on the back wall between the inlet and outlet port openings is a cylindrical spring retainer 44.

An upper portion of a liquid passage 48 extends through the sprayer housing 12 communicating the discharge passage inlet opening 30 with the outlet port 42 of the pump chamber. The interior surface of the liquid passage 48 is cylindrical. A valve stem 50 projects downwardly from the sprayer housing 12 through the interior of the liquid passage 48. The valve stem 50 extends beyond the liquid discharge passage inlet opening 30 to a distal end of the stem positioned adjacent the outlet port opening 42 of the pump chamber. The valve stem has at least one groove, but is shown with a pair of grooves 52 formed in the exterior surface of the valve stem 50. The grooves 52 begin at an intermediate portion of the valve stem opposite the liquid discharge passage inlet opening 30 and extend to the distal end of the valve stem opposite the pump chamber outlet port opening 42.

A pressure regulator or pressure buildup valve 54 is mounted on the valve stem 50 for reciprocating movement of the valve over the exterior surface of the stem. The pressure buildup valve 54 has a cylindrical interior surface that slides over the exterior surface of the valve stem 50 but does not block the pair of grooves 52 formed in the valve stem exterior surface. An exterior surface of the pressure buildup valve 54 mates in sliding engagement with the cylindrical interior surface of the liquid passage 48. The sliding engagement between the exterior surface of the pressure buildup valve 54 and the interior surface of the liquid passage 48 prevents a flow of liquid between these two engaging surfaces. The pressure buildup valve 54 also comprises a downwardly projecting, generally, conically shaped sealing surface 56. A coil spring 58 is mounted over the valve stem 50 and engages between the sprayer housing 12 and the top of the pressure buildup valve 54. The coil spring 58 biases the pressure buildup valve downwardly.

A separate vent chamber housing section 60 is assembled to the sprayer housing 12. The vent chamber housing section 60 comprises a cylindrical column 62 that extends upwardly into the sprayer housing 12 and forms a lower portion of the liquid passage 64. An inlet port opening 66 of the column is positioned adjacent the inlet port opening 40 of the pump chamber. A lower end of the column has a valve seat 68 formed therein and a ball check valve 70 is contained in the column on the valve seat. A dip tube 72 is connected to the bottom of the column and communicates with the liquid in the liquid container 22 to which the trigger sprayer 10 is attached.

A vent chamber 74 is also formed in the vent chamber housing section 60. The vent chamber 74 has a cylindrical side wall 76. An access opening 78 is provided at the front or left hand end of the vent chamber 74 as viewed in FIG. 1, and an exit port opening 80 is provided at the rear or right hand end of the vent chamber. As seen in the drawing figures, the exit port opening 80 extends through the vent chamber housing section 60 communicating the lower portion of the liquid passage 64 with the vent chamber 74 through the exit port opening 80. A slot opening 82 is provided through the vent chamber side wall 76 communicating the vent chamber 74 with the interior of the liquid container 22 to which the trigger sprayer is attached. As explained earlier, the bottom of the vent chamber housing section 62 has the cap 20 mounted thereon.

A valve element formed as a tubular, resilient sleeve 86 is press fit into the lower portion of the liquid passage 64 contained in the vent chamber housing section 60. A lower section 88 of the valve element 86 is press fit into the lower portion of the liquid passage 64. This lower section 88 has a cylindrical, tubular configuration and the exterior surface of the section closes over the exit port 80 at the rearward end of the vent chamber 74 in the at rest configuration of the valve element shown in FIG. 1. In the at rest configuration of the valve element lower section 88, it closes communication between the pump chamber 34 and the liquid container 22 through the exit port opening 80. A series of openings 90 are provided through the cylindrical wall of the valve element 86 intermediate the element lower section 88 and an upper section 92 of the element. The hollow interior 94 of the valve element permits a flow of liquid from the liquid container, through the dip tube 72 bypassing the ball check valve 70, through the lower section 88 of the valve element and the series of openings 90 and through the two inlet port openings 66, 40 into the pump chamber 34. A pair of criss-crossing arms 96 at the bottom of the valve element lower section 88 prevent the ball check valve 70 from seating in the interior of the valve element lower section and constrain the ball check valve to movement within the lower portion of the liquid passage 64 between the valve seat 68 and the pair of arms 96.

The valve element upper section 92 is also press fit into the column 62 of the vent chamber housing section as seen in the drawing figures. The interior bore 94 of the valve element does not extend entirely through the element upper section 92 and is blocked by a top wall 98. An opposite side of the top wall 98 from the interior bore 94 engages against the distal end of the valve stem 50. Projecting upwardly from the valve element top wall 98 and spaced radially from the exterior surface of the valve stem 50 is a cylindrical valve seat 100. The valve seat 100 is configured to receive the conical sealing surface 56 of the pressure regulator or pressure buildup valve 54 as shown in FIG. 1. The engagement of the sealing surface 56 of the pressure buildup valve 54 with the cylindrical valve seat 100 seals closed fluid communication from the pump chamber 34 through the outlet port 42 to the pair of grooves 52 formed in the valve stem 50 and the upper portion of the liquid passage 48.

The nozzle head 14 has a construction that is similar to that employed in trigger sprayers of the prior art. The nozzle head includes a tubular projection 104 that is inserted into the liquid discharge passage 26 through the nozzle head opening 28 of the passage. The hollow interior of the tubular projection 104 forms a part of the liquid discharge passage 26 extending to an end wall 106 of the nozzle head. A nozzle orifice 108 extends through the end wall 106. A fluid spinner assembly 110 is contained in the interior of the tubular projection 104 adjacent the nozzle orifice 108. The fluid spinner assembly 110 imparts a swirl to liquid flowing through the discharge passage 26 toward the nozzle orifice 108 to dispense the liquid from the orifice in a spray pattern. Alternatively, other known constructions of nozzle heads may be employed with the trigger sprayer 10 of the invention to dispense liquid from the sprayer as a spray, stream and/or foam.

The trigger 16 is mounted to the trigger sprayer 10 in a conventional manner to permit pivoting movement of the trigger 16 relative to the sprayer housing 12. The trigger 16 is operatively connected to the piston assembly 18 in any conventional matter.

The piston assembly 18 includes a pump piston 118 and a vent piston 120 that are integrally connected to each other. The pump piston 118 is mounted in the pump chamber 34 for sliding reciprocating movement within the cylindrical side wall 36 of the pump chamber. The vent piston 120 is mounted in the vent chamber 74 for sliding reciprocating movement within the cylindrical side wall 76 of the vent chamber. A coil spring 122 is mounted between the spring retainer 44 in the pump chamber and the pump piston 118. The coil spring 122 biases the pump piston 118 to the charge position of the pump piston relative to the pump chamber shown in FIG. 1. What is meant by the charge position is that position of the pump piston 118 relative to the pump chamber 34 that the piston moves to in the pump chamber to increase the interior volume of the pump chamber in creating a vacuum in the pump chamber 34 to draw liquid from the liquid container 22 up through the dip tube 72 and the lower portion of the liquid passage 64 into the pump chamber. From the charge position of the pump piston 118 shown in FIG. 1, manual pivoting of the trigger 16 toward the sprayer housing 12 causes the pump piston 118 to move to the right as shown in FIG. 1 from its charge position to a discharge position of the pump piston 118 relative to the pump chamber 34 shown in FIGS. 3 and 4. What is meant by the discharge position of the pump piston relative to the pump chamber is that position that the pump piston 118 is moved to in the pump chamber 34 to decrease the interior volume of the pump chamber and increase the pressure of the fluid contained in the pump chamber.

Figure 3:
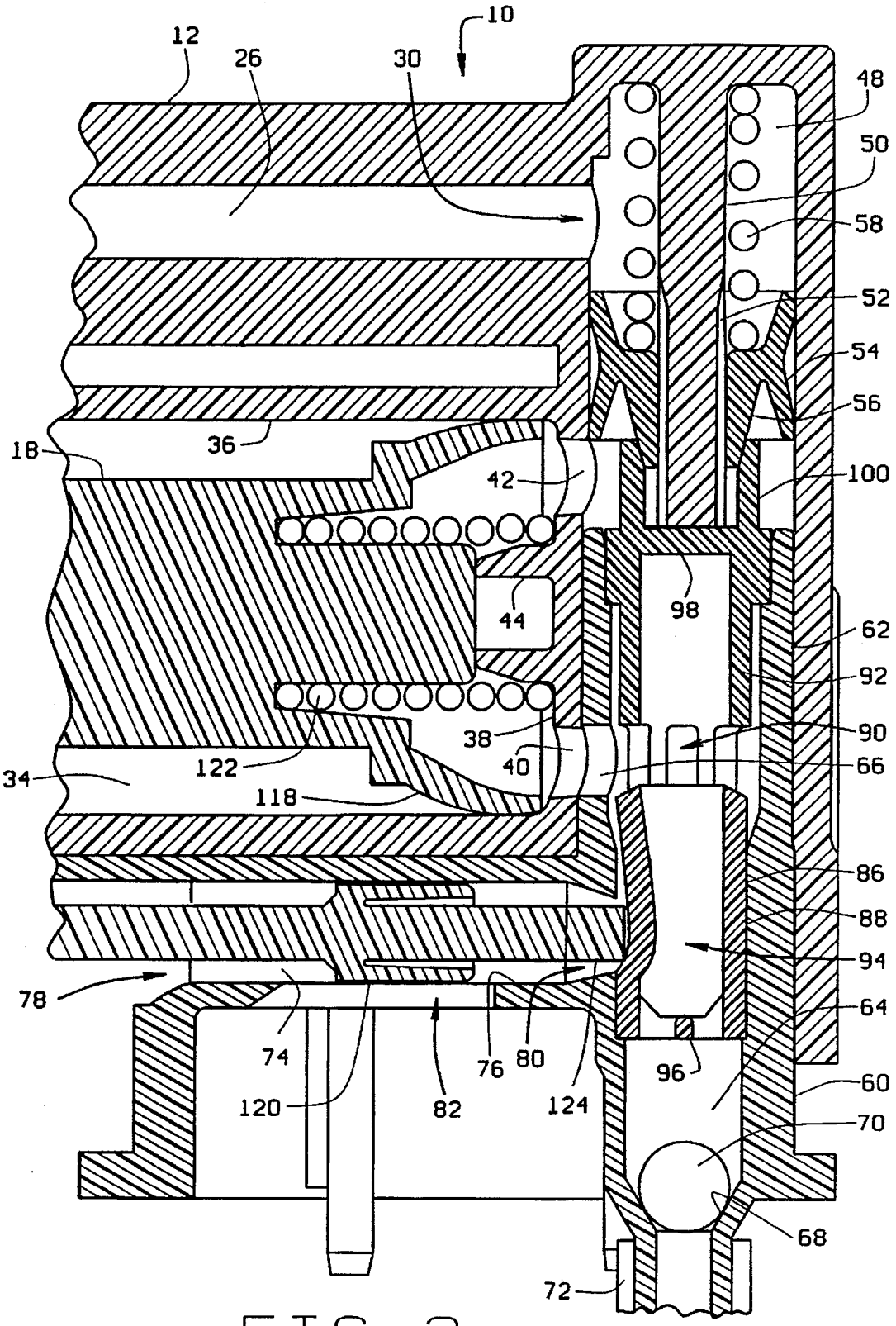
FIG. 3 is a similar view to FIG. 2 showing the relative positions of the component parts of the trigger sprayer in venting air from the pump chamber to the liquid container to which the sprayer housing is attached.
Figure 4:
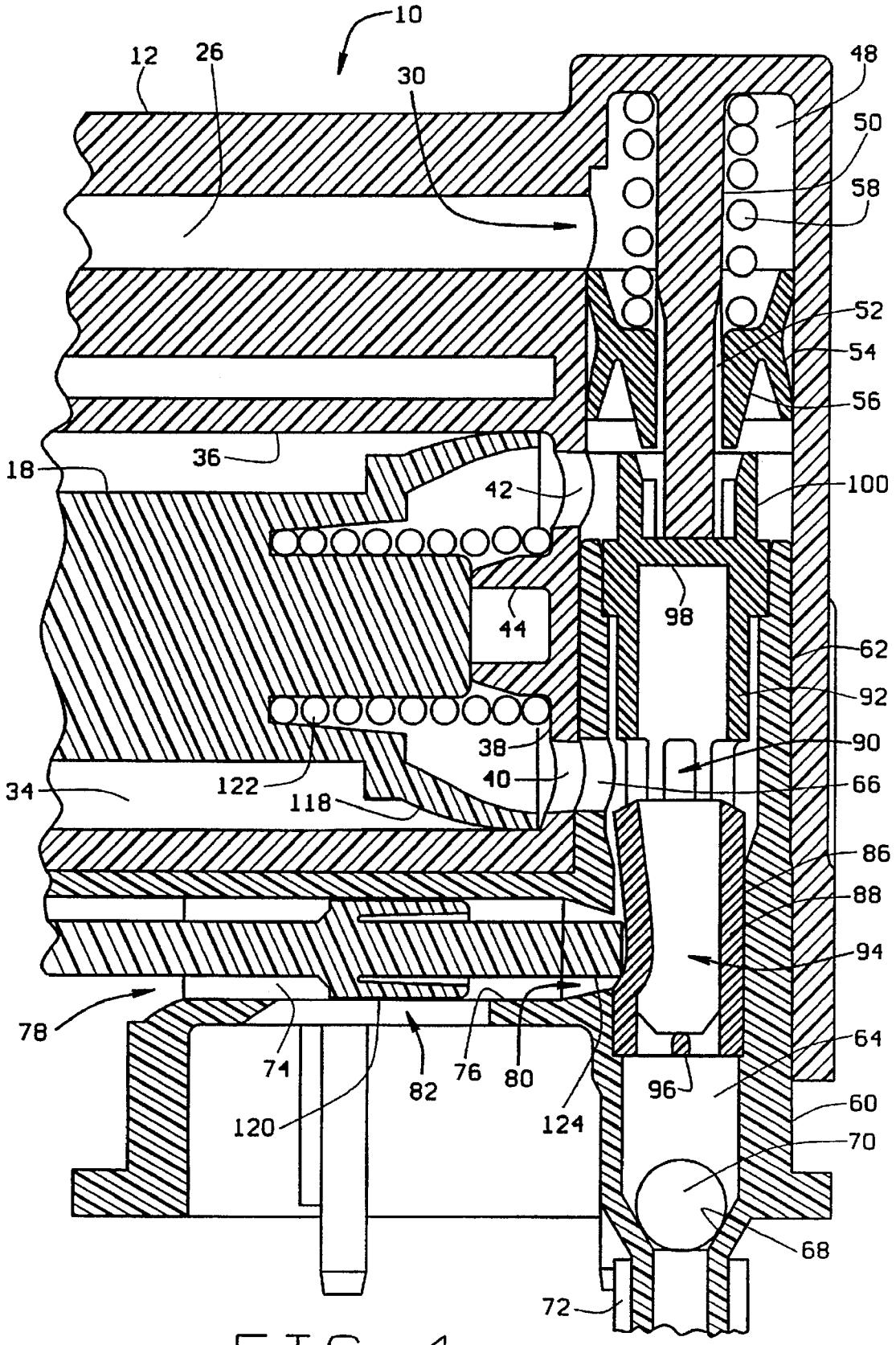
FIG. 4 is a similar view to FIG. 2 showing the relative positions of the component parts of the trigger sprayer in pumping liquid from the pump chamber, past the pressure buildup valve to the discharge passage of the sprayer.

The vent piston 120, being integrally connected to the pump piston 118 by the piston assembly 18, moves simultaneously with the pump piston from a closed position of the vent piston 120 relative to the vent chamber 74 shown in FIG. 1 where the vent piston blocks communication of the liquid container interior with the exterior environment of the trigger sprayer through the vent chamber 74 and the vent chamber slot opening 82, and a vent position of the vent piston 120 in the vent chamber 74 shown in FIGS. 3 and 4 where the position of the vent piston permits communication between the exterior environment of the trigger sprayer and the interior of the liquid container through the vent chamber 74 and the vent chamber slot opening 82.

Projecting from the vent piston 120 is a rod 124 having a length dimensioned to extend through the exit port opening 80 at the rearward end of the vent chamber 74 and engage against the exterior of the valve element lower section 88 in response to the pump piston 118 being moved to the discharge position in the pump chamber 34 and the vent piston 120 being simultaneously moved to the vent position in the vent chamber 74.

In operation of the trigger sprayer, the trigger is pivoted causing the pump piston to move to the discharge position to force the air from the pump chamber prior to priming the pump. As the pump piston 118 is moved to the discharge position and the vent piston 120 is moved to the vent position, the vent piston rod 124 extends through the exit port opening 80 and compresses the resilient lower section of the valve element 88, separating this section from closing over the exit port opening 80. As seen in FIGS. 3 and 4, with the vent piston rod 124 compressing the lower section of the valve element 88 away from the exit port opening 80, communication is established between the pump chamber 34 and the interior of the liquid container 22 attached to the trigger sprayer through the inlet port opening 40 in the back wall of the pump chamber, the inlet port opening 66 in the column 62 of the vent chamber housing section, the lower portion of the liquid passage 64 bypassing the lower section 88 of the valve element, the exit port opening 80, the vent chamber 74 and the vent chamber slot opening 82. This path of communication between the pump chamber 34 and the interior of the liquid container 22 permits air to be forced from the pump chamber and into the liquid container along this communication path when priming the pump.

As the pump piston 118 is subsequently moved by the coil spring toward the charge position of the pump piston in the pump chamber, the vent piston moves from the vent position of the piston in the vent chamber 74 toward the closed position of the vent piston. As the vent piston moves, the vent rod 124 is withdrawn through the exit port opening 80 and disengages from the resilient lower section 88 of the valve element, permitting the lower section to return to its at rest position shown in FIG. 1 closing over the exit port opening 80. This position of the valve element lower section 88 blocks the fluid communication between the pump chamber 34 and the interior of the liquid container 22. As the pump piston 118 moves toward the charge position in the pump chamber 34, a vacuum is created in the pump chamber that draws liquid from the liquid container through the dip tube 72, past the ball check valve 70, through the interior 94 and the series of openings 90 of the valve element and through the two inlet openings 66, 40 into the pump chamber 34 thereby charging the pump chamber with the liquid. On the next succeeding reciprocation of the pump piston 118 toward the discharge position in the pump chamber 34, the decrease in the interior volume of the pump chamber causes the liquid contained therein to increase in pressure. Because the liquid is incompressible, it immediately exerts a force on the pressure buildup valve 54. When the force of liquid pressure on the valve increases to the level that it exceeds the force of the coil spring 58, the liquid pressure force causes the valve to move upwardly over the valve stem 50 against the bias of the coil spring 58. As the pressure buildup valve 54 moves upwardly over the valve stem 50, the conical sealing surface 56 of the valve unseats from the cylindrical valve seat 100, thereby enabling the liquid contained in the pump chamber 34 to flow through the outlet port opening 42 bypassing the pressure buildup valve 54 and the cylindrical valve seat 100, through the pair of grooves 52 on the valve stem 50 and through the upper portion of the liquid passage 48, through the inlet opening 30 of the liquid discharge passage 26 and through the liquid discharge passage 26 to the nozzle orifice 108 in the nozzle head 14 from which the liquid is dispensed from the trigger sprayer.

Figure 5:
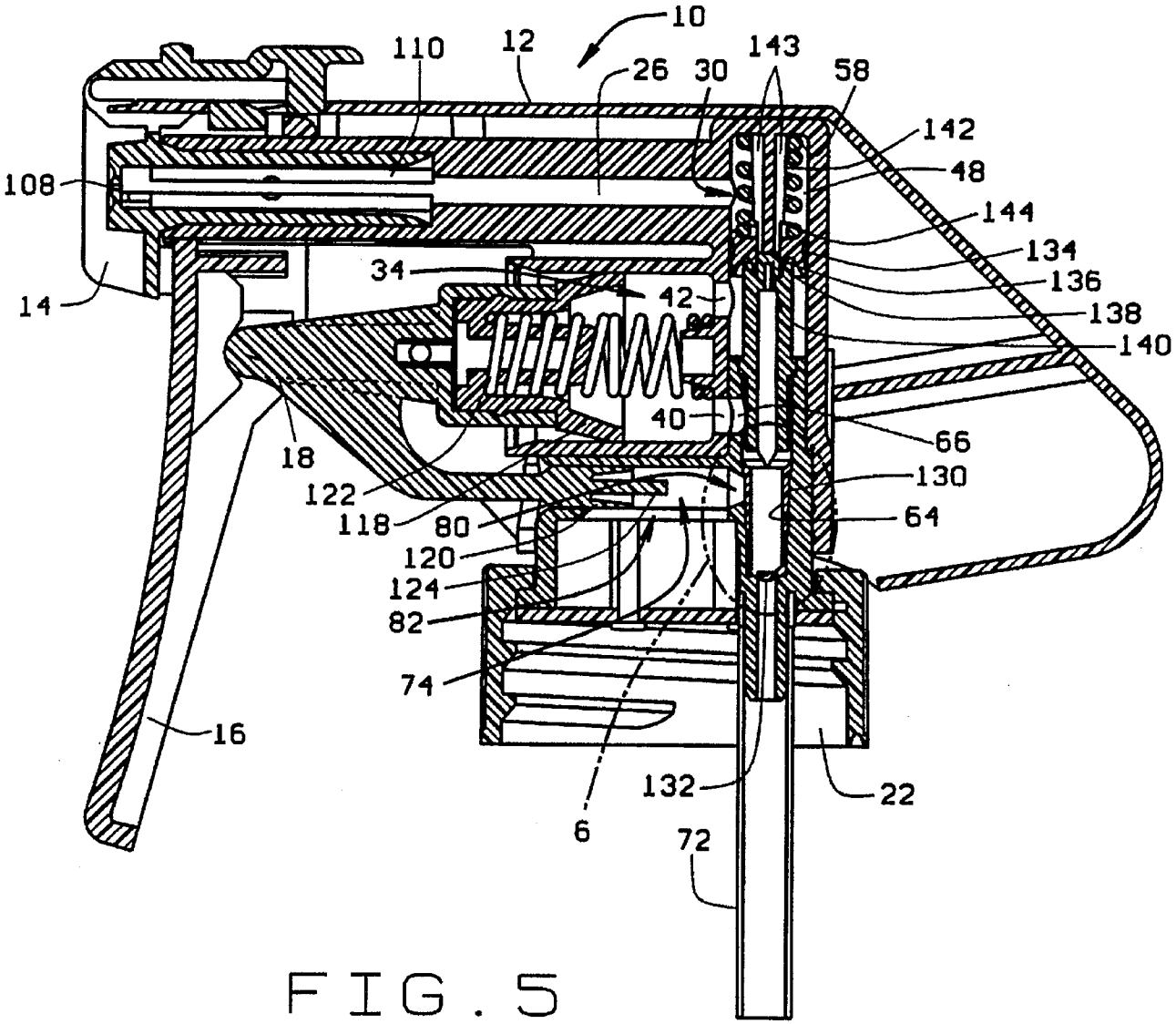
FIG. 5 is a side elevation view, in section, of a second embodiment of the pressure buildup trigger sprayer of the invention having a modified pressure buildup valve assembly and an air vent sleeve with an integral check valve.

An alternate embodiment of the sprayer shown in FIG. 5 employs a modified pressure buildup valve assembly and a valve element 130 having a check valve 132 connected thereto. The remainder of the component parts of the sprayer are similar to the parts previously described and are therefore identified by like reference numerals.

The modified valve assembly includes a pressure buildup valve 134 mounted on a valve stem 142 for reciprocating movement of the valve over the exterior surface of the stem. The stem 142 is formed with a plurality of grooves 143 along its length. The pressure buildup valve 134 has a downwardly projecting, generally conically shaped exterior sealing surface 136 that is shaped to be received in and seat in sealing engagement with a cylindrical interior surface of a valve seat 138. The valve seat 138 has a cylindrical center post 140 that projects upwardly at the center of the cylindrical interior surface of the valve seat 138. The top of the center post 140 engages with the bottom of the valve stem 142. The pressure buildup valve 134 has a cylindrical interior bore that slides over the cylindrical exterior surface of the valve seat post 140 to prevent a flow of liquid between these engaging surfaces. The exterior surface of the pressure buildup valve 134 mates in sliding engagement with the cylindrical interior surface of the liquid passage 48, also to prevent a flow of liquid between these engaging surfaces. The coil spring 58 biases the pressure buildup valve downwardly, while a valve stop 144 formed on the valve stem 142 limits movement of the valve in the upward direction.

While the pressure buildup valve is in its downwardly biased position shown in FIG. 5, the valve prevents a flow of fluid from the pump chamber 34 through the liquid passage 48 to the discharge passage 26. The biasing force of the spring 58 prevents the valve 134 from unseating from the center post until the pump chamber 34 is primed with liquid. After the pump chamber has been primed, and the pump piston is moved towards the discharge position, the pressure of the liquid contained within the pump chamber increases until the force of liquid pressure exerted on the valve exceeds the force of the spring biasing the valve to its closed position. Once this level of pressure is reached, the buildup valve begins to move upwardly along the valve seat post 140 and valve stem 142 against the force of the spring 58. However, not until the liquid pressure is sufficient to lift the pressure buildup valve 134 above the center post 140 can liquid from the pump chamber flow through the liquid passage 48 along the valve stem grooves 143 bypassing the pressure buildup valve 134 and into the liquid discharge passage. Thus, while the pressure buildup valve of the previously described embodiment permitted a flow of liquid through the pair of grooves 52 formed in the valve stem 50 as soon as the valve 54 was displaced from the valve seat 100, the valve assembly shown in FIG. 5 requires greater displacement of the valve 134 before a flow of liquid is permitted. Moreover, while the desired minimum pressure required to unseat the pressure buildup valve in either embodiment can be adjusted by changing the bias of the coil spring 58, for the embodiment shown in FIG. 5 the desired minimum pressure required to permit a flow of liquid can also be adjusted by changing the height of the valve seat post 140. By extending the length of the post 140 from that shown in FIG. 5, a greater liquid pressure in the pump chamber 34 is needed to unseat the valve 134 from the seat 138 and expose the stem grooves 143. By lessening the length of the post 140, a lesser liquid pressure is required.

Also shown in FIG. 5 is valve element 130 with the check valve 132 connected thereto. The check valve 132 of this alternate embodiment is a flapper valve, and is integrally formed with the valve element 130. What is meant by a flapper valve is a valve 132 having a hinge 133 connection to the sprayer housing that permits the valve to pivot relative to the sprayer housing about the hinge connection between open and closed positions of the valve relative to the sprayer housing. The check valve 132 formed integrally with the sleeve 130 eliminates the need for the ball valve 70 of the previously described embodiment. The valve element is a resilient sleeve similar to that of the previously described embodiment and functions in a similar manner. The sleeve 130 is press fit into the lower portion of the liquid passage 64 and forms a portion of the liquid passage which closes over the exit port opening 80.

Figure 7:
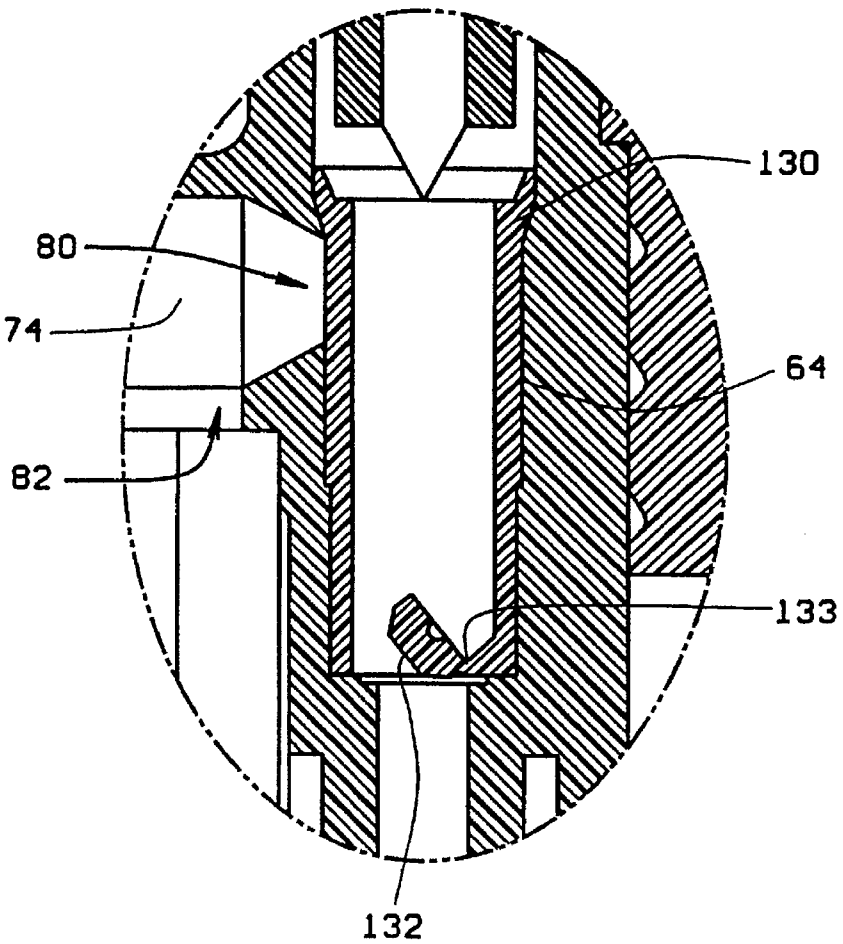
FIG. 7 is a partial elevation view, in section, of the encircled portion of the trigger sprayer of FIG. 5 illustrating the check valve in an open position.
Figure 6:
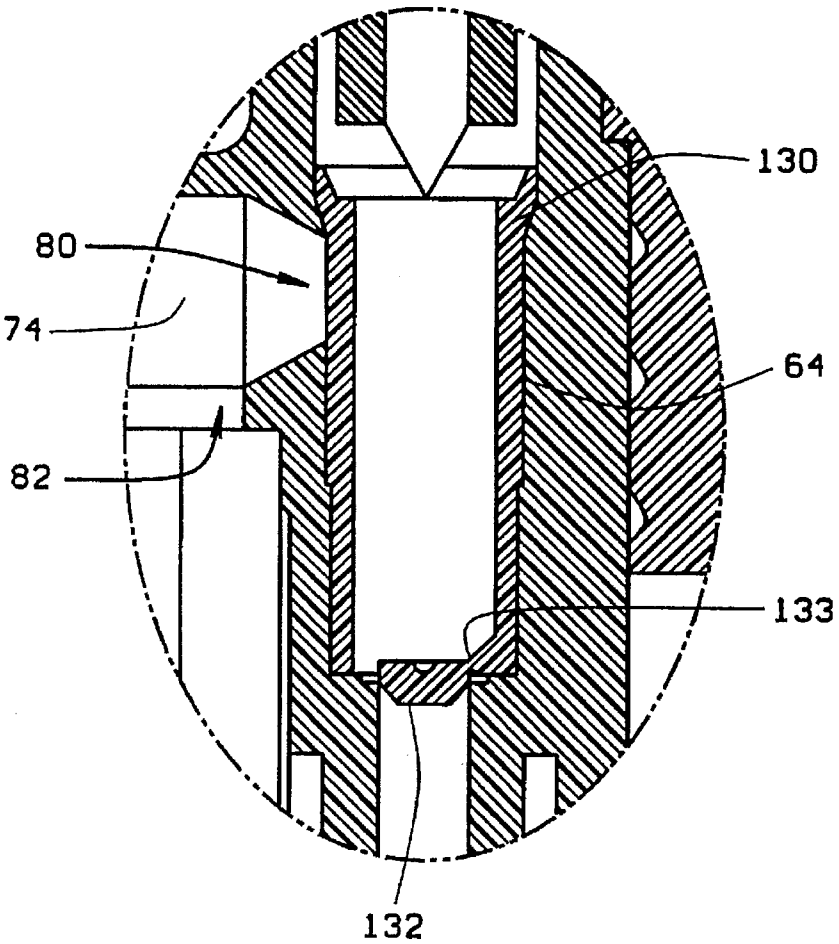
FIG. 6 is a partial elevation view, in section, of the encircled portion of the trigger sprayer of FIG. 5 illustrating the check valve in a closed position.

When the pump piston 118 is moved to the discharge position, the vent rod 124 extends through the exit port opening 80 and displaces the resilient sleeve 130 from the exit port opening, thereby allowing air in the pump chamber 34 to bypass the resilient sleeve and vent through the exit port opening 80, the vent chamber 74, and the vent chamber slot opening 82 and pass into the liquid container 22. At this time, the check valve 132 is in the closed position illustrated in FIGS. 5 and 6 and prevents fluid from the pump chamber from passing through the resilient sleeve 130 and into the liquid container through the dip tube 72. As the pump piston is subsequently moved from the discharge position toward the charge position, the vent rod 124 disengages from the resilient sleeve 130 and the sleeve closes the exit port opening 80. The continued movement of the piston 118 toward the charge position creates a vacuum in the pump chamber 34. The vacuum causes the check valve 132 to open as illustrated in FIG. 7, and draws liquid from the liquid container through the resilient sleeve and into the pump chamber.

By integrally forming the check valve 132 with the valve element 130, the number of component parts of the sprayer is reduced and the assembly of the sprayer is simplified. Alternatively, the check valve 132 could be integrally formed with the lower portion of the liquid passage 64, and a similar flapper valve could be integrally formed with the liquid passage and positioned to close over the exit port opening 80, thereby eliminating the valve element 130.

In both embodiments of the sprayer, because the liquid contained in the pump chamber is incompressible and quickly rises to the pressure level necessary to open the pressure buildup valve 54, once the pump chamber 34 has been primed with the liquid, it is not necessary to move the pump piston 118 completely to its discharge position shown in drawing FIG. 4 to discharge the liquid from the trigger sprayer. It should be appreciated that by the time the pump piston reaches the discharge position shown in FIG. 4 substantially all of the liquid that had been drawn into the pump chamber has been dispensed from the trigger sprayer. Therefore, it is not necessary to move the piston completely to the discharge position once the pump chamber has been primed with liquid in order to dispense the liquid from the trigger sprayer. With shorter discharge strokes of the pump piston in the pump chamber once the pump chamber has been primed, the vent piston rod 124 will not extend through the exit port opening 80 and engage the valve element. The shorter pump piston discharge strokes would prevent any discharge of liquid in the pump chamber through the aligned inlet port openings 40, 66, bypassing the valve element, and into the liquid container through the vent chamber 74 and the vent chamber slot opening 82. Operating the trigger sprayer in this manner will cause all of the liquid drawn into the pump chamber to be dispensed from the trigger sprayer through the nozzle orifice 108 while avoiding discharging any of the liquid from the pump chamber back into the liquid container.

Each trigger sprayer of the invention described above provides a pressure buildup trigger sprayer that dispenses liquid from the sprayer only when the manual actuation of the pump piston has caused the liquid to increase in pressure to a-level of pressure sufficient to unseat the pressure buildup valve from its valve seat. When the liquid is caused to reach this pressure level, it is then dispensed from the trigger sprayer. In addition, when priming the pump, the pressure buildup trigger sprayer of the invention permits the venting of air contained in the pump chamber 34 through the sprayer housing 12 to the interior of a liquid container 22 to which the sprayer is attached. The construction of the pressure buildup trigger sprayer enables venting of the air from the pump chamber without creating any openings in the sprayer housing through which the liquid could leak from the housing.

While the present invention has been described by reference to specific embodiments, it should be understood that modifications and variations of the invention may be constructed without departing from the scope of the invention defined in the following claims.

What is claimed is:

1. A sprayer for dispensing liquid from a liquid container at a minimum pressure, the sprayer comprising:

a sprayer housing;

a connector on the sprayer housing for attaching the sprayer housing to a liquid container;

a manually operated pump on the sprayer housing for drawing liquid from the container to the pump, and for pumping the liquid from the pump and discharging the liquid from the sprayer housing;

a supply passage in the sprayer housing for conveying the liquid drawn from the container to the pump;

a discharge passage in the sprayer housing for conveying the liquid pumped from the pump and discharged from the sprayer housing; and a pressure buildup valve received in the discharge passage for reciprocating movement between a closed position of the valve in the discharge passage and an open position of the valve in the discharge passage, the movement of the valve between the closed and open positions including movement of the valve through a first portion of the discharge passage while the valve blocks liquid flow through the discharge passage and movement of the valve through a second portion of the discharge passage while the valve permits liquid flow through the discharge passage, the second portion of the discharge passage having a surface with a groove formed in the surface, the valve being in sliding engagement with the second portion surface as it moves through the second portion of the discharge passage while permitting liquid flow through the groove bypassing the valve.

2. The sprayer of claim 1, wherein:

a spring biases the valve toward the closed position against a pressure of the liquid pumped from the pump into the discharge passage and maintains the valve in the first portion of the discharge passage while the pressure of the liquid is below a desired minimum pressure, the spring permitting the valve to move from the first portion of the discharge passage into the second portion in response to the pressure of the liquid pumped from the pump rising above the desired minimum pressure.

3. The sprayer of claim 2, wherein:

the spring biases the valve from the second portion of the discharge passage into the first portion of the discharge passage in response to the pressure of the liquid pumped from the pump into the discharge passage dropping below the desired minimum pressure.

4. The sprayer of claim 2, wherein:

the spring is replaceable with another spring which maintains the valve in the first portion of the discharge passage while the pressure of the liquid pumped from the pump into the discharge passage is below a second desired minimum pressure.

5. The sprayer of claim 2, wherein:

the spring is a coil spring received in the discharge passage adjacent the valve.

6. The sprayer of claim 1, wherein:

the first portion of the discharge passage has a cylindrical surface extending therethrough and the valve engages in sliding engagement with the cylindrical surface as it moves through the first portion of the discharge passage while preventing liquid flow between the valve and the cylindrical surface.

7. The sprayer of claim 6, wherein:

the cylindrical surface is an exterior surface of a post that extends through the first portion of the discharge passage, and the valve has a center bore that engages in sliding engagement over the post as the valve reciprocates in the first portion of the discharge passage.

8. The sprayer of claim 6, wherein:

the second portion surface is an exterior surface of a stem that extends through the second portion of the discharge passage, the groove is formed into the stem, and the valve has a center bore that engages in sliding engagement over the stem exterior surface as the valve reciprocates in the second portion of the discharge passage.

9. The sprayer of claim 7, wherein:

the second portion surface is an exterior surface of a stem that extends through the second portion of the discharge passage coaxially with and adjacent to the post, the groove is formed into the stem, and the valve has a center bore that engages in sliding engagement over the stem exterior surface as the valve reciprocates in the second portion of the discharge passage.

10. The sprayer of claim 9, wherein:

the valve is a piston having a peripheral surface that engages in sliding engagement with an interior surface of the discharge passage, the valve center bore extends through the piston, and the piston is mounted on both the post and the stem for reciprocating sliding movement of the piston over the post and the stem.

11. A sprayer for dispensing liquid from a liquid container at a minimum pressure, the sprayer comprising:

a sprayer housing;

a connector on the sprayer housing for attaching the sprayer housing to a liquid container;

a manually operated pump on the sprayer housing for drawing liquid from the container to the pump, and for pumping the liquid from the pump and discharging the liquid from the sprayer housing;

a supply passage in the sprayer housing for conveying the liquid drawn from the container to the pump;

a discharge passage in the sprayer housing for conveying the liquid pumped from the pump and discharged from the sprayer housing, the discharge passage having a first portion with a cylindrical surface extending therethrough and a second portion with a surface extending therethrough and a groove formed in the second portion surface; and, a pressure buildup valve received in the discharge passage for reciprocating movement between a closed position of the valve in the discharge passage and an open position of the valve in the discharge passage, the valve has a surface that slides in engagement with the cylindrical surface of the discharge passage first portion when the valve moves through the first portion of the discharge passage preventing a flow of liquid through the discharge passage between the valve and the cylindrical surface, and that slides in engagement with the discharge passage second portion surface when the valve moves through the second portion of the discharge passage permitting a flow of liquid through the discharge passage between the valve and the second portion surface through the groove formed in the second portion surface.

12. The sprayer of claim 11, wherein:

a spring biases the valve toward the closed position against a pressure of the liquid pumped from the pump into the discharge passage and maintains the valve in the first portion of the discharge passage while the pressure of the liquid is below a desired minimum pressure, the spring permitting the valve to move from the first portion of the discharge passage into the second portion in response to the pressure of the liquid pumped from the pump rising above the desired minimum pressure.

13. The sprayer of claim 12, wherein:

the spring biases the valve from the second portion of the discharge passage into the first portion of the discharge passage in response to the pressure of the liquid pumped from the pump into the discharge passage dropping below the desired minimum pressure.

14. The sprayer of claim 12, wherein:

the spring is replaceable with another spring which maintains the valve in the first portion of the discharge passage while the pressure of the liquid pumped from the pump into the discharge passage is below a second desired minimum pressure.

15. The sprayer of claim 11, wherein:

the second portion surface is an exterior surface of a stem that extends through the second portion of the discharge passage, the groove is formed into the stem, and the valve has a center bore that engages in sliding engagement over the stem exterior surface as the valve moves through the second portion of the discharge passage.

16. The sprayer of claim 15, wherein:

the cylindrical surface of the discharge passage first portion is an exterior surface of a post that extends through the first portion of the discharge passage, and the valve center bore engages in sliding engagement over the post as the valve moves in the first portion of the discharge passage.

17. The sprayer of claim 16, wherein:

the valve is a piston having a peripheral surface that engages in sliding engagement with an interior surface of the discharge passage, the valve center bore extends through the piston, and the piston is mounted on both the post and the stem for reciprocating sliding movement of the piston over the post and the stem.

18. The sprayer of claim 16, wherein:

the stem and the post abut against each other in the discharge passage and are coaxial.

19. The sprayer of claim 11, wherein:

the discharge passage has a discharge orifice through which the liquid pumped from the pump is discharged from the sprayer housing, and no valves are positioned in the discharge passage between the pressure buildup valve and the discharge orifice.

20. A sprayer for dispensing liquid from a liquid container at a minimum pressure, the sprayer comprising:

a sprayer housing;

a connector on the sprayer housing for attaching the sprayer housing to a liquid container;

a manually operated pump on the sprayer housing for drawing liquid from the container to the pump, and for pumping the liquid from the pump and discharging the liquid from the sprayer housing;

a supply passage in the sprayer housing for conveying the liquid drawn from the container to the pump;

a discharge passage in the sprayer housing for conveying the liquid pumped from the pump and discharged from the sprayer housing; and a pressure buildup valve received in the discharge passage for reciprocating movement between a closed position of the valve in the discharge passage and an open position of the valve in the discharge passage, the movement of the valve between the closed and open positions including movement of the valve through a first portion of the discharge passage while the valve blocks liquid flow through the discharge passage and movement of the valve through a second portion of the discharge passage while the valve permits liquid flow through the discharge passage, the first portion of the discharge passage having a cylindrical surface extending therethrough and the valve being in sliding engagement with the cylindrical surface as it moves through the first portion of the discharge passage while preventing liquid flow between the valve and the cylindrical surface, the cylindrical surface comprising an exterior surface of a post that extends through the first portion of the discharge passage, the valve having a center bore that engages in sliding engagement over the post as the valve reciprocates in the first portion of the discharge passage.

21. The sprayer of claim 20, wherein:

the second portion surface is an exterior surface of a stem that extends through the second portion of the discharge passage coaxially with and adjacent to the post, the groove is formed into the stem, and the valve has a center bore that engages in sliding engagement over the stem exterior surface as the valve reciprocates in the second portion of the discharge passage.

22. The sprayer of claim 21, wherein:

the valve is a piston having a peripheral surface that engages in sliding engagement with an interior surface of the discharge passage, the valve center bore extends through the piston, and the piston is mounted on both the post and the stem for reciprocating sliding movement of the piston over the post and the stem.

* * * * *